United States Patent [19]

Belanger, Jr. et al.

[11] Patent Number: 4,837,657

[45] **Date of Patent: * Jun. 6, 1989**

[54] ELECTROSTATIC DISCHARGE DEVICE

[75] Inventors: Thomas D. Belanger, Jr., Clarendon Hills; Roy L. Johnson, Arlington Heights, both of Ill.

[73] Assignee: AG Communication Systems Corporation, Phoenix, Ariz.

[ * ] Notice: The portion of the term of this patent subsequent to Mar. 14, 2006 has been disclaimed.

[21] Appl. No.: 134,481

[22] Filed: Dec. 17, 1987

[51] Int. Cl.[4] ..... H05F 3/02

[52] U.S. Cl. ..... 361/220

[58] Field of Search ..... 361/212, 220

[56] References Cited

U.S. PATENT DOCUMENTS 4,439,809 3/1984 Weight et al. ..... 361/220

*Primary Examiner*—L. T. Hix
*Assistant Examiner*—David M. Gray
*Attorney, Agent, or Firm*—Anthony Miologos

[57] ABSTRACT

A device for conducting electrostatic potentials to a protection ground is disclosed. The device includes an electrically conductive center section mounted on a substrate mounting device, with the center section electrically connected to the protection ground. First and second arms having an electrically conductive coating extend from opposite sides of the center section. During the installation of a circuit substrate to the substrate mounting device an associated arm is arranged to contact a metalized edge of the circuit substrate providing an electrical path for discharging electrostatic potentials from the circuit substrate to the protection ground.

6 Claims, 2 Drawing Sheets

ELECTROSTATIC DISCHARGE DEVICE

CROSS-REFERENCE TO RELATED APPLICATIONS

The present application is related to applicant's co-pending application Ser. No. 134,482, titled, "A DEVICE FOR DISCHARGING ELECTROSTATIC POTENTIALS", having a common inventive entity and a common assignee.

BACKGROUND OF THE INVENTION

This invention relates in general to electrostatic discharge devices and more particularly to an arrangement for discharging electrostatic potentials during the installation of an electrical substrate to a carrier substrate.

In the past few years, the use of plug-in units for electrical components has found favor within the electronics industry. Such plug-in units generally comprise a structure upon which are mounted electrical assemblies or sub-assemblies, the structure being arranged to be plugged in a suitable socket provided on a base chassis. When so plugged the components carried by the plug-in unit are electrically connected in proper circuit relation to other electrical equipment carried by the base chassis.

However, with the development of film circuits, the need for a specialized carrier structure for housing the sub-assembly has disappeared. This is due to the smaller size of a film circuit. Compared to circuits fashioned with discrete components the film circuit is appreciably smaller and lighter. It is not uncommon to have film circuits plugged directly into larger circuit cards or other carrier substrates and in turn the larger substrate plugged into the base chassis.

At present, most installations of a film circuit to a circuit card is done as a permanent installation. Therefore, removal and replacement of a film circuit though not impossible, is a tedious and labor intensive job.

One method for installing electronic substrates to a carrier substrate is taught by applicant's co-pending U.S. patent application titled, SUBSTRATE MOUNTING DEVICE. This arrangement used guides attached to a carrier substrate, such as a conventional circuit board, to accept and terminate an electronic substrate such as a hybrid film circuit deposited on a ceramic substrate.

During the installation of the above mentioned devices a possibility exists that during handling, one substrate may assume an electrical potential greater than the other. Further, during the installation of the hybrid substrate onto the carrier substrate the possibility also exists of an electrostatic charge building-up, due to the the dissimilar materials used for the guides and the hybrid film circuit. The sudden discharge of such an electrical potential can have catastrophic consequences on the sensitive low voltage components of the hybrid and/or carrier substrate.

It therefor becomes an object of the present invention to provide an arrangement for bringing an electronic substrate to the same potential as a carrier substrate.

SUMMARY OF THE INVENTION

In accomplishing the object of the present invention there is provided an electrostatic discharge device. The device of the present invention includes a center section having an electrically conductive coating applied over a layer of resilient material. The center section further includes an aperture for accommodating a threaded fastener, which is used to mount the center section to a substrate mounting device. An L-shaped conductive path extending from the center section electrically connects the center section to a protection ground a first resilient arm extending outward from the center section includes an electrically conductive coating deposited over a layer of resilient material and is also electrically connected to the center section. A second resilient arm also extends outward from the center section directly opposite the first arm. The second arm is constructed in the same manner as the first arm.

The electrostatic discharge device of the present invention is used to advantage during the installation of a circuit substrate to the substrate mounting device. As a circuit substrate is installed on the substrate mounting device the associated first or second arm conductive coating contacts a metalized edge of the circuit substrate. The arm is urged backwards toward the substrate mounting device during installation. This allows the arm to apply a slight pressure to the circuit substrate edge in the same manner as a wiping contact. During the Installation an electrical path is maintained from the circuit substrate via the associated arm the center section and the L-shaped conductive path to the protection ground.

Any electrostatic potentials which may have been present or developed during installation of the circuit substrate are safely dissipated instantly to the protection ground.

BRIEF DESCRIPTION OF THE DRAWINGS

A better understanding of the invention may be had from the consideration of the following detailed description taken in conjunction with the accompanying drawings in which.

DESCRIPTION OF THE PREFERRED EMBODIMENT

Figure 1:
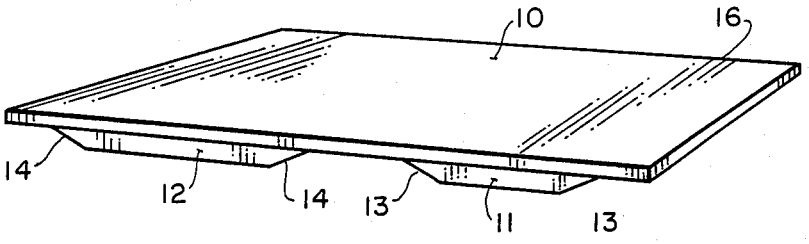
FIG. 1 is a perspective view of a substrate having guide rails used with the present invention.
Figure 2:
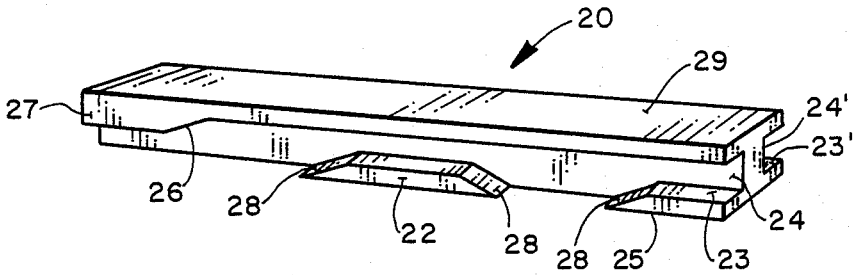
FIG. 2 is a perspective view of a substrate guide used with the present invention.
Figure 3:
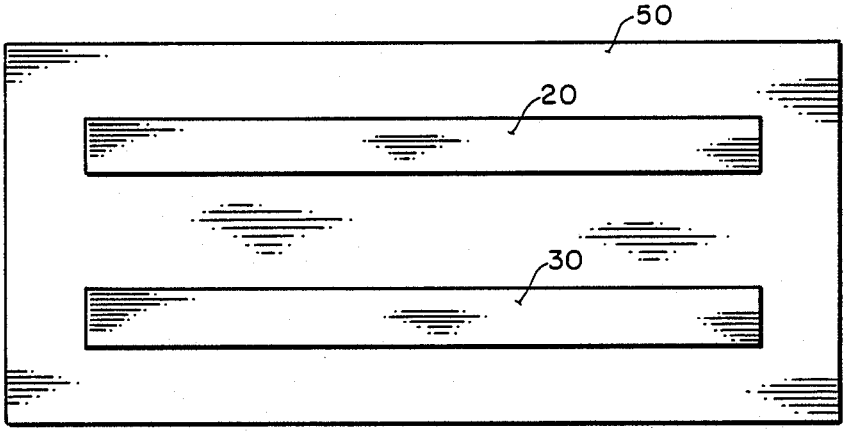
FIG. 3 is a top plan view of the substrate mounting device used with present invention mounted on a carrier substrate.

Turning now to FIGS. 1, 2 and 3 of the included drawings, a device of the type in which the invention is used to advantage is illustrated. A better understanding of the device may be had by referring to applicants co-pending U.S. patent application Ser. No. 101,893 filed Sept. 25, 1987, entitled SUBSTRATE MOUNTING DEVICE.

The device includes a planar substrate 10 having forward guide rails 11 and rear guard rails 12 attached or molded onto the substrate 10 along the edge of one of the substrates 10 major sides. A similar set of guide rails (not shown) are also positioned on the opposite major side of the substrate. Edges 15 and 16 of substrate 10 include a continuous layer of conductor material electrically connected to a protection ground trace on substrate 10.

Guide 20 is a integrally molded unit comprised of at least one slot or channel, such as channel 24 extending longitudinally along an inner side of guide 20. Channel 24 is defined between a planar top cap or surface 29 and a forward drop guide 23 and rear drop guide 22. Additionally, the channel 24 extends from an opening at the forward end of the guide 20 to a top guide 27 at the rear. Both the forward and rear drop guides include ramped ends 28 to aid in the positioning and removal of the substrate 10. Finally, guide 20 includes a generally planar bottom surface 25 for mounting the guide to a carrier substrate.

A pair of guides 20 and 30 form the substrate mounting device shown in FIG. 3. Guide 30 is a mirror image in structure to guide 20.

The substrate mounting device is attached by any convenient means to the top surface of a carrier substrate 50 such as a circuit card, backplane, or other electrical substrate.

The substrate 10 including forward guide rail 12 and rear guard rail 11 is inserted into channel 24 of guide 20 and pushed forward within the guide. forward rail 12 rides within the channel between the forward drop guide 23, rear drop guide 22 and the top cap 29 until guide rails 11 and 12 fall into respective openings made by drop guides 23 and 22.

Figure 4:
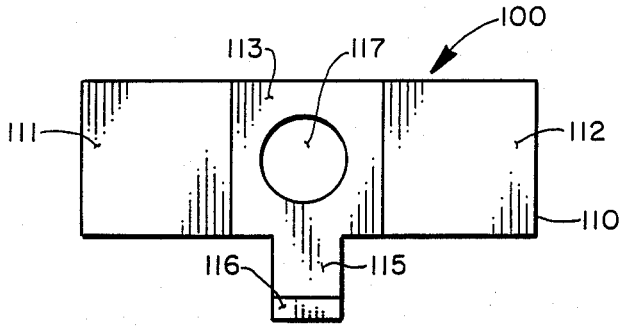
FIG. 4 is an elevational view of the device of the present invention.
Figure 5:
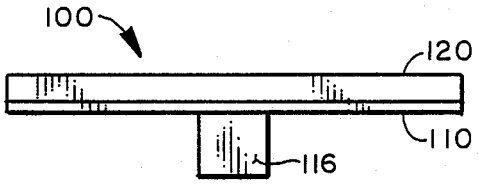
FIG. 5 is a top plan view of the device of FIG. 4.
Figure 6:
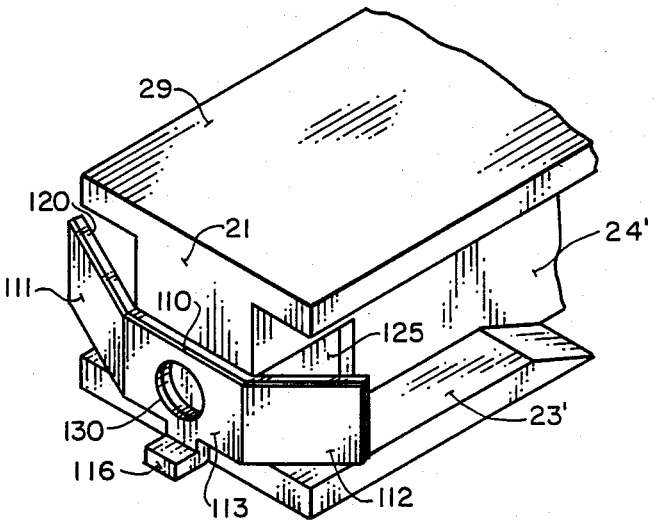
FIG. 6 is a perspective view of the device of the present invention mounted to a substrate guide in accordance with the present invention.

Turning now to FIGS. 4 and 5 the electrostatic discharge device of the present invention is illustrated. The T-shaped device 100, includes a center section 113, arms 111 and 112 extending from opposite ends of center section 113, a leg 115 extending downward from center section 113 and foot 116 connected to leg 115. Sections 113 and 111, 112 of device 100 are composed of a layer of silicon rubber material 120, having a layer of conductor material 110 such as gold, copper, or any other material having good electrically conductive qualities deposited substantially over layer 120. Leg 115 is composed of the same conductive material of layer 110 and extends a conductor path from the center section 113 of device 100 to foot 116. Foot 116 is also composed of the same electrically conductive material as leg 115. An orifice 117 is centrally located on section 113 and is used to mount the device 100 to guide 20 and/or 30.

Turning now to FIG. 3, the installation of the device 100 to guide 20 will be illustrated. It will be appreciated by those skilled in the art that the device can be also mounted to guide 30 and that the following explanation of the device mounted to only guide 20 is done for clarity and therefor, the invention is not limited thereto. As can be seen the device 100 is mounted to the front of guide 20 with the center section 113 against surface 21 of guide 20. A fastener 130 is inserted into orifice 117 which engages a threaded bore on surface 21 (not shown) mounting the device to guide 20. With device 100 mounted on guide 20, arms 111 and 112 extend into respective channel openings and foot 116 rests on the surface of carrier substrate 50. Foot 116 which functions as a terminal tab, is electrically connected to a protection ground trace (not shown) on carrier substrate 50. The electrical connection between foot 116 and the protection ground trace can be accomplished by any one of many convenient methods such as soldering, or press-fitting. With foot 116 electrically connected to the protection ground, layer 120 of device 100 assumes the electrical potential of the protection ground.

When substrate 10 is installed into guide 20 metalized edges 16 of substrate 10 contacts arm 111 of device 100. As substrate 10 is inserted onto guide 20, arm 111 is urged back into channel 24 until it rests into a recess, such as the recess 125 shown on channel 24'. The resilient quality of the silicon rubber allows the the arms to flex inward toward the channel providing a constant pressure against edge 16 in the manner of a wiping contact, as substrate 10's metalized surface 16 travels within the channel of guide 20.

Any destructive electrical potentials which may have built up on the substrate are safely conducted to protection ground via surface 111, leg 115 and foot 116. Similarly, any static voltages which may build up due to the insertion process of the substrate 10 into guides 20 are also dissipated by device 100. With the substrate fully installed on the guide, protection ground remains connected between substrate 10 and the carrier substrate 50 providing an electrical path for extraneous voltage or current surges to be safely dissipated.

When carrier substrate 10 is withdrawn, arms 111 and 112 spring back to their original position and assume a position to contact the substrate during the next insertion.

Although the preferred embodiment of the invention has been illustrated, and that form described in detail, it will be readily apparent to those skilled in the art that various modifications may be made therein without departing from the spirit of the invention or from the scope of the appended claims.

What is claimed is:

1. An electrostatic discharge device comprising:

a center section having an electrically conductive surface, said center section including means for mounting said center section to a substrate mounting device, and means for electrically connecting said center section to a protection ground;

a first resilient arm extending outward from said center section, said first arm including an electrically conductive surface electrically connected to said center section;

a second resilient arm extending outward from said center section directly opposite said first arm, said second arm including an electrically conductive surface electrically connected to said center section; and, responsive to the installation of a circuit substrate to said substrate mounting device, said first arm contacts an edge of said circuit substrate allowing said first arms electrically conductive surface to electrically connect to said circuit substrate thereby, providing an electrical path for discharging electrostatic potentials from said circuit substrate to said protection ground and alternatively responsive to the installation of a circuit substrate to said substrate mounting device, said second arm contacts an edge of said circuit substrate allowing said second arms electrically conductive surface to electrically connect to said circuit substrate thereby, providing an electrical path for discharging electrostatic potentials from said circuit substrate to said protection ground.

2. The electrostatic discharge device as claimed in claim 1, wherein: said center section and said first and second arms further include a layer of resilient material having said electrically conductive surface deposited thereon, said resilient layer arranged to allow said first and second arms to be urged back toward said substrate mounting device during the installation of said circuit substrate.

3. The electrostatic discharge device as claimed in claim 1, wherein: said substrate mounting guide includes a threaded bore and said means for mounting said center section is an aperture extending thru said center section arranged to accommodate a threaded fastener therein, said threaded fastener arranged to engage said threaded bore securing said electrostatic discharge device to said substrate mounting device.

4. The electrostatic discharge device as claimed in claim 1, wherein: said means for electrically connecting said center section to a protective ground includes a leg portion having one end integrally joined and extending downward from said center section and a foot portion extending horizontally from a second opposite end of said leg portion, said leg and said foot portion each are composed of an electrically conductive material as an integral unit with said foot portion arranged to be electrically connected to said protection ground.

5. The electrostatic discharge device as claimed in claim 2, wherein: said circuit mounting device includes a first and a second recess arranged to accommodate and house therein said first and said second arms respectively when said said first and second arms are urged back toward said circuit mounting device during installation of said circuit substrate.

6. An electrostatic discharge device comprising:

a center section including a layer of resilient material having an electrically conductive surface deposited thereon, said center section including means for mounting said center section to a substrate mounting device, and means for electrically connecting said center section to a protection ground;

a first resilient arm extending outward from said center section, said first arm including a layer of resilient material having an electrically conductive surface deposited thereon, said electrically conductive surface electrically connected to said center section;

a second resilient arm extending outward from said center section directly opposite said first arm, said second arm including a layer of resilient material having an electrically conductive surface deposited thereon, said electrically conductive surface electrically connected to said center section; and, responsive to the installation of a circuit substrate to said substrate mounting device, said first arm contacts an edge of said circuit substrate allowing said first arm to be urged back toward said substrate mounting device during the installation of said circuit substrate, and said first arms electrically conductive surface to electrically connect to said circuit substrate thereby, providing an electrical path for discharging electrostatic potentials from said circuit substrate to said protection ground and alternatively, responsive to the installation of a circuit substrate to said substrate mounting device, said second arm contacts an edge of said circuit substrate allowing said second arm to be urged back toward said substrate mounting device during the installation of said circuit substrate, and said second arms electrically conductive surface to electrically connect to said circuit substrate thereby, providing an electrical path for discharging electrostatic potentials from said circuit substrate to said protection ground.

* * * * *